US005305531A

United States Patent [19]

Cole et al.

[11] Patent Number: 5,305,531

[45] Date of Patent: Apr. 26, 1994

[54] STAMP INDEXING TOOL

[75] Inventors: Charles H. Cole, Des Plaines; James Mueller, Schaumburg, both of Ill.

[73] Assignee: HPC, Inc., Schiller Park, Ill.

[21] Appl. No.: 38,829

[22] Filed: Mar. 29, 1993

[51] Int. Cl.[5] ..... B41B 11/00; B41B 3/02

[52] U.S. Cl. ..... 33/622; 33/1 D; 33/614

[58] Field of Search ..... 33/622, 1 D, 613, 614, 33/623, 645, 670, 677, 679; 235/101

[56] References Cited

U.S. PATENT DOCUMENTS 1,632,966 6/1927 Heinze ..... 33/622

4,531,296 7/1985 Veeze ..... 33/670

OTHER PUBLICATIONS

"The Stamper", HPC Catalog, 1981, p. 38 (month unknown).

"New Key Stamp Holder", Locksmith Ledger Jul. 1977, p. 193.

*Primary Examiner*—William A. Cuchlinski, Jr.

*Assistant Examiner*—C. W. Fulton

*Attorney, Agent, or Firm*—David D. Kaufman

[57] ABSTRACT

A portable tool for use by locksmiths and the like with an indexable slide having a positioning hole for nicely receiving a conventional chisel-type stamp. The tool has an adjustable clamp for releasably gripping and retaining a thin object, such as a key blank on a key bed beneath the slide and positoning hole. Spaced detents provide a guide for spacing and, by indexing the slide as desired, the stamp indicia can be applied in a neat and evenly spaced manner.

18 Claims, 2 Drawing Sheets

FIG. 3
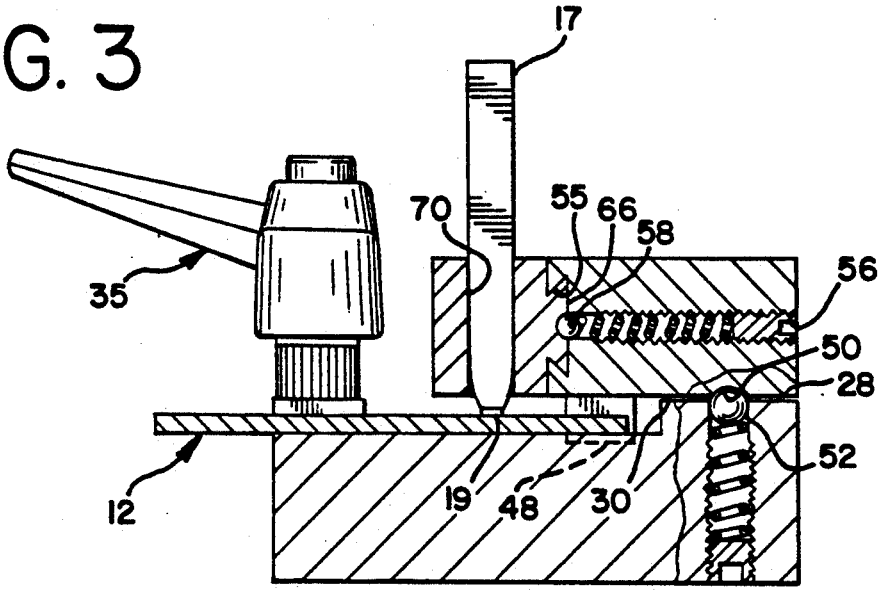
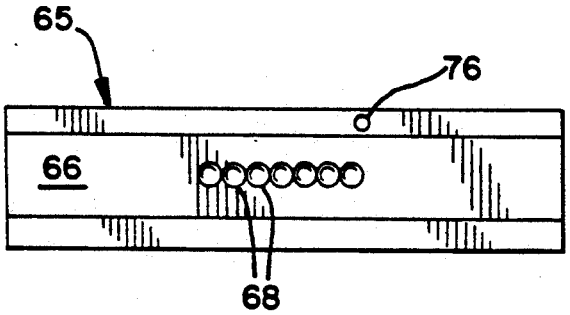
FIG. 4
FIG. 5
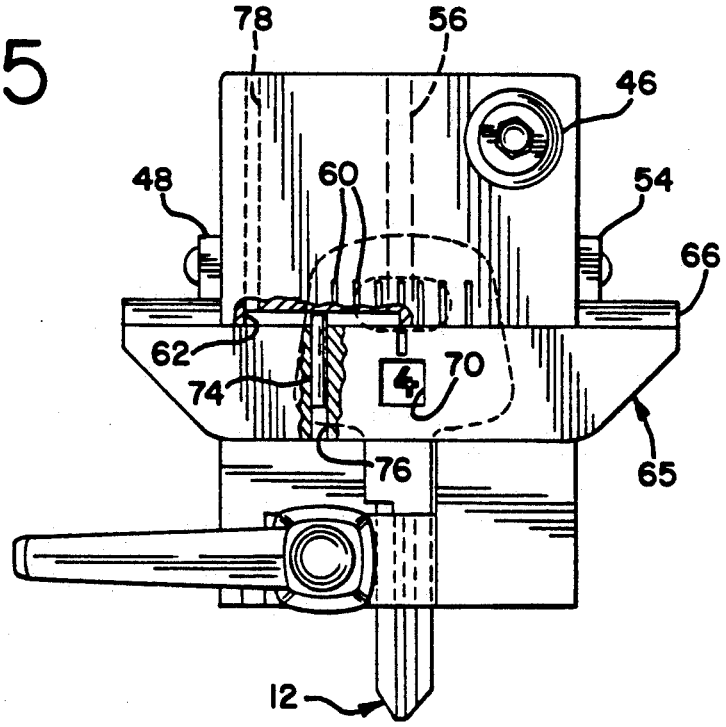

STAMP INDEXING TOOL

This invention relates to guides or tools for percussion stamps and, more particularly, to a tool for indexing and accurately positioning the stamps used by locksmiths or others to apply identifying information to keys or other relatively thin and flat objects.

BACKGROUND OF THE INVENTION

Originally manufactured keys carry identifying information, such as, names, number codes, etc., which is impressed or embossed thereon by automated, mass production processes. When a locksmith is required to duplicate a key or replace a lost key, the key blank that is employed is devoid of the original information. The locksmith is thereupon required to apply the information to the head of the key manually.

In general, information is cut or stamped into a key blank with sets of individual stamps. Each of the stamps comprises an elongated slug, usually rectangular in cross section, having a word, number, letter, or other character, cut on one face thereof. The information carrying face is positioned on the key blank and the stamp is then tapped with a hammer to chisel or engrave the information into the key. Since the keys are made of relatively hard metal, the accurate positioning of the stamp to apply the character carried thereby is not easily accomplished. When application of a series of characters is required, such as a multi-digit code, the accurate and neat stamping of those characters becomes particularly difficult.

Prior known locksmith tools have included structures in which the point of application of the stamp was fixed so that the key being stamped was required to be moved for the successive application of multiple stamps. Accurate placement of the stamped indicia thus was difficult and dependent on the visual acuity of the locksmith. In addition, repeated percussive blows over a period of use could result in damage or misalignment to any movable beds designed to hold the keys.

There thus exists a need for a tool or device capable of accurately positioning and spacing locksmith stamps of the type described so that the characters may be easily applied to the key in a neat and properly spaced manner.

SUMMARY OF THE INVENTION

The present invention provides a simple-to-use tool that is compatible with conventional chisel-type stamps for positioning and holding the stamp while the character thereon is applied to the key. The tool includes indexing means so that a plurality of characters may be applied with neat and uniform spacing.

Briefly, the invention comprises a base block having an adjustable clamp mounted thereon for releasably positioning a key blank thereon. A swivel block is pivotally mounted on the base block and is pivotable to expose the surface of the base block while the key blank is being properly positioned and gripped thereon by the clamp. A stamp indexing block is slidably carried in the swivel block. When the swivel block is pivoted back to the operative position the indexing block is positioned over the head of the key blank. The indexing block is formed with a positioning hole therethrough of the same configuration as the stamps being used by the locksmith so that a stamp is positionable therethrough and is positioned for tapping with a hammer or the like.

The indexing block is formed with a plurality of appropriately spaced detents so that sliding movement thereof properly positions the positioning hole for receipt of successive stamps to provide proper spacing for the information being applied to the key.

Grid-like indicators are provided on the base block to guide the user of the tool for precise positioning of the key blank as desired. The entire tool is small and portable and easy to handle.

Numerous other advantages and features of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout.

FIG. 3 is a vertical sectional view substantially on the plane of line 3—3 of FIG. 2;

FIG. 4 is an elevational view of the inner face of the indexing block removed from the swivel block; and FIG. 5 is a top plan view of the tool with portions broken away to reveal details of construction.

DETAILED DESCRIPTION OF THE INVENTION

Figure 1:
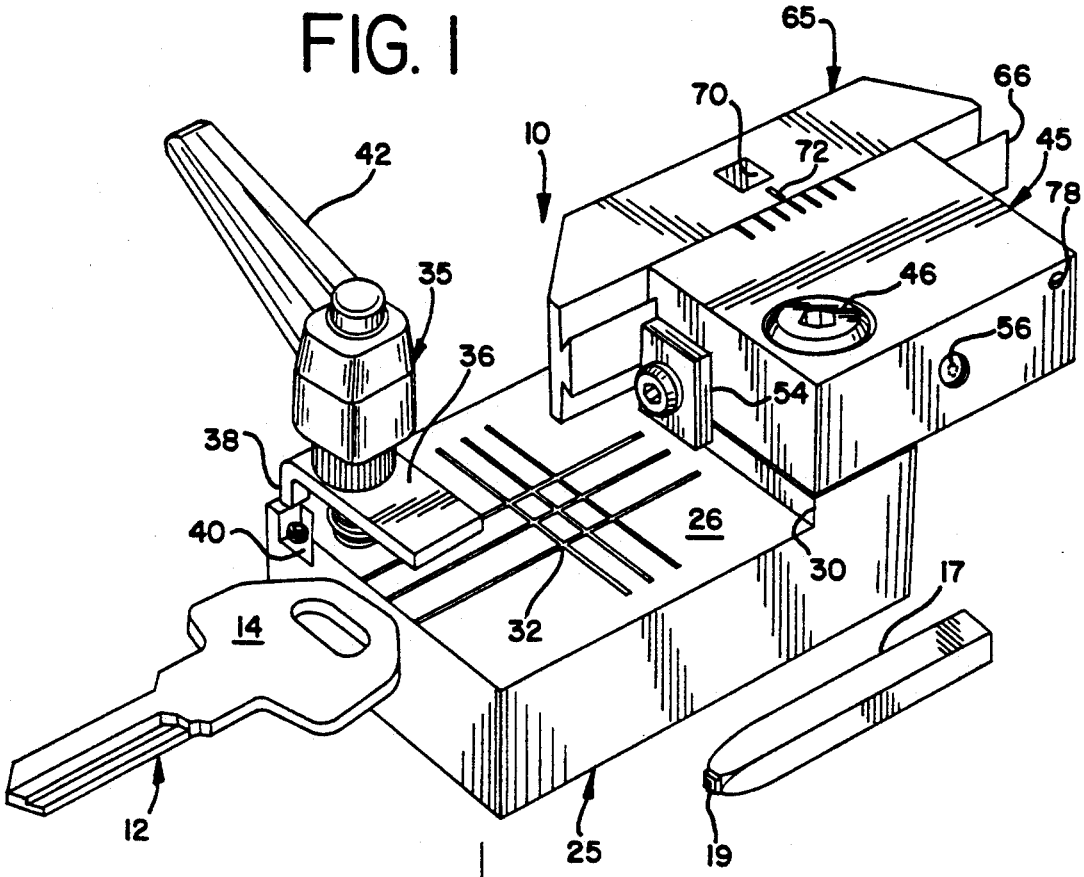
FIG. 1 is a perspective view of a key stamp indexing tool embodying the principles of the invention and illustrating the swivel and indexing blocks in the inoperative position preparatory to the insertion of the key to the block for stamping.
Figure 2:
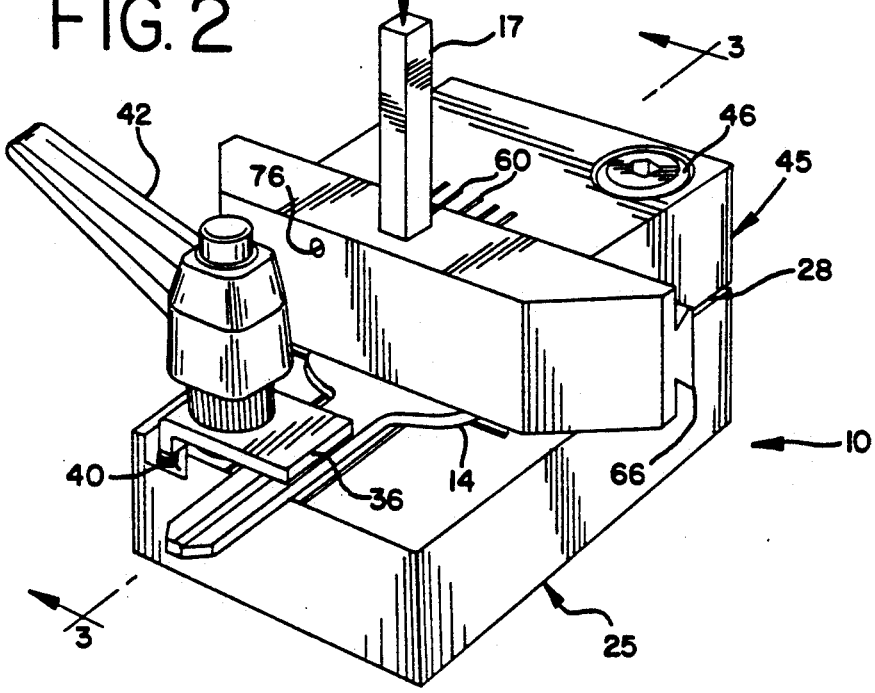
FIG. 2 is a similar view showing the indexing block in the operative position with a key blank positioned for stamping.

Referring with greater particularity to FIGS. 1 and 2 of the drawings, reference numeral 10 indicates generally a locksmith key stamp indexing tool embodying the principles of the invention. Indexing tool 10 is adapted for use with conventional keys such as key blank 12 having an enlarged head portion 14, and conventional slug- or chisel-type stamps, such as 17 having a rectangular shaft and a tip 19 formed with a character to be cut into the key head.

Indexing tool 10 comprises a base block 25, said base block comprising a planar key bed 26 and a rear, raised surface 28 separated from the bed by a shoulder 30. Key bed 26 is provided with a series of grid lines 32 for guiding the locksmith in centering or positioning the key blank head 14 as desired for the application of the stamp characters thereto.

Adjustable key clamp means 35 is pivotally mounted on the base block 25. Key clamp means 35 comprises a horizontal plate 36 having an integral depending projection 38 loosely positioned within a notch 40 formed in the key bed 26 of the base block. Threaded tightening means, such as a handle 42, carries the plate 36 and is threadedly received in the base block. Manipulation of the handle 42 thus permits loosening and raising of the plate 36 so that the same may be pivoted to permit insertion thereunder of a key blank 12 whereupon the handle is rotatable to tighten the plate 36 to firmly grip the key blank on the key bed 26.

A swivel block 45 is pivotally mounted on the key bed raised surface 28 by means of a suitable swivel post or bolt 46. A left stop plate 48 is secured to the left sidewall of block 45 and bears against the left sidewall of the base block 25 to accurately align the two blocks when the swivel block is in the operative position (see FIGS. 3 and 5). The bottom surface of the swivel block is also formed with a detent 50 which cooperates with a spring urged ball bearing 52 mounted in the base block 25 to insure proper alignment of the two blocks in the operative position. A right stop plate 54 is secured to the right sidewall of the block 45, said plate being shorter in length than the left side plate 48 and adapted to pass above the key bed 26 and bear against the shoulder 30 when the swivel block 45 is pivoted to the inoperative position as illustrated in FIG. 1.

A keyway or guide 55 is formed in the front face of the swivel block 45 and said guide communicates with a bore 56 formed centrally in said swivel block (see FIG. 3). A spring-urged indexing ball bearing 58 is retained in the bore 56 for purposes which will subsequently be described. On its top surface, the swivel block 45 is provided with a plurality of spaced indexing marks 60, the middle one of said marks being in vertical alignment with the indexing bearing 58. The front face of the swivel block 45 is also formed with a retainer slot 62 for purposes which will likewise become apparent as the description proceeds.

Cooperating with the swivel block 45 is an indexing block 65. Indexing block 65 comprises a key or slide 66 adapted to slide laterally in the guide 55. A plurality of indexing detents 68 is formed in the face of slide 66, said detents being equal in number and spacing to the indexing marks 60, and being adapted to releasably receive therein the indexing bearing 58. A vertical positioning hole 70 is centrally formed through the indexing block 65, said hole being of complementary configuration with the stamp 17 and adapted to nicely receive and retain the same therein for application of its character 19 to an operationally retained key 12. A central index line 72 is also provided on the top surface of the indexing block 65 for adjustable alignment and registration with the indexing marks 60 on the swivel block 45.

Suitable retention means is provided for retaining indexing block 65 in swivel block 45 and preventing removal therefrom. The retention means illustrated comprises a roll bar 74 snugly fitted into a hole 76 formed in the indexing block 65. The roll bar 74 projects from the indexing block and into the retainer slot 62 in the front face of the swivel block 45 (see FIG. 5). In the event disassembly might be required, a hole 78 is formed through the swivel block 45 whereby the roll bar 74 may be punched or forced out when the holes 76 and 78 are in alignment.

Operation and use of the stamp indexing tool 10 should now be apparent. With the swivel block 45 pivoted to the inoperative position and the clamp means 35 loosened, a key blank 12 is placed on the key bed 26, the grid lines 32 being utilizable to position or center the key head as desired. The handle 42 is tightened to securely grip the key as positioned and the swivel block pivoted back to the operative position with the positioning hole 70 above the head of the key. Indexing block 65 can thereupon be moved to position the hole 70 at the desired number of positions so that the appropriate stamp 17 can be inserted through the hole and its information applied to the key with a hammer or mallet where desired. The information is thus applied to the key in a neat and properly spaced arrangement.

In the embodiment illustrated, the handle 42 is provided with a spring mounting so that the same can be raised, if required, and pivoted away from impingement with the swivel block without affecting the setting of the clamp plate 36. It should, however, be appreciated that other forms of handles, including a simple thumbscrew, may also be employed for operating the key clamp means 35. Similarly, while the stamps 17 and positioning hole 70 have been shown as rectangular in section, the same might also comprise any other appropriate configurations, such as, circular, ovate or triangular.

While the invention has been described in connection with a key, it should be appreciated that the same is equally applicable to other relatively thin and flat objects. Thus, for example, the tool can be used for applying indicia to animal tags, luggage tags, serial number tags, and the like.

From the foregoing description, it should be apparent that the invention provides a novel, portable tool which is simple to use for neatly and accurately applying indicia to keys with conventional stamps of the type typically employed by locksmiths. It should also be understood that the language employed herein is for purposes of description rather than limitation, and that various changes and modifications can be made without departing from the spirit and scope of the invention which is defined in the appended claims.

What is claimed is:

1. An indexing tool for stamps comprising:
   - a base block having a planar bed for supporting a relatively thin and flat object thereon;
   - an adjustable clamp operable to releasably hold the object on said bed;
   - a second block mounted on said base block;
   - an indexing block slidably mounted on said second block, said indexing block being formed with a hole for receiving a stamp therein; and
   - spaced detents cooperable between said second block and indexing block for selectively positioning said hole over the clamped object at a plurality of positions for applying stamp indicia to the object.

2. An indexing tool according to claim 1 wherein said clamp comprises a handle threadedly mounted on said base block and a horizontal plate carried by said handle whereby said plate is engageable over the object to securely retain the same on the planar bed.

3. An indexing tool according to claim 2 wherein said plate is pivotally carried by said handle so that the plate is pivotable to facilitate placement of the object thereunder and removal therefrom.

4. An indexing tool according to claim 1 wherein said base block comprises a raised section separated from the planar bed by a shoulder, said second block being mounted on said raised section.

5. An indexing tool according to claim 4 wherein said second block comprises a swivel block pivotally mounted on said planar bed and pivotable between an operative position wherein the indexing block is positioned over the planar bed and an inoperative position wherein said planar bed is visually exposed for placement of the object thereon.

6. An indexing tool according to claim 5 comprising a grid of guide lines for facilitating the accurate placement of the object on the planar bed for the application of stamp indicia thereon.

7. An indexing tool according to claim 5 comprising a stop plate secured to an edge of said swivel block and engaging a side of said base block to facilitate alignment of the indexing block in the operative position.

8. An indexing tool according to claim 5 comprising a detent in the bottom of said swivel block and a spring-urged ball bearing in the base block cooperable with the detent to insure accurate alignment of the indexing block in the operative position.

9. An indexing tool according to claim 7 comprising a second stop plate secured to an opposite edge of said swivel block and engaging said shoulder to limit the pivotal movement of the swivel block into the inoperative position.

10. An indexing tool according to claim 1 wherein said second block comprises a guide in a front face thereof, said indexing block comprising a slide on a rear face thereof of complementary configuration with the guide and laterally slidable therein.

11. An indexing tool according to claim 10 comprising a plurality of detents formed in said slide and a spring-urged ball bearing carried by said second block whereby said ball bearing is releasably engageable in any of said detents.

12. An indexing tool according to claim 11 comprising a series of indexing marks on the top surface of said second block opposed to said hole, said marks being spaced apart equally with the spacing between said detents and providing a visual indicator of the relative position of the hole.

13. A portable locksmith tool for accurately aligning and spacing indicia of chisel-type stamps manually applied to a key blank comprising:

a base having a planar key bed and a planar raised rear section separated from the key bed by a shoulder;

a handle-operated adjustable clamp mounted on said bed for releasably retaining a key blank on said bed;

a swivel block pivotally mounted on said rear section;

an indexing block mounted from the front face of said swivel block and laterally movable thereon, said indexing block being formed with a vertical hole therethrough adapted to releasably retain a stamp therein so that the indicia tip of the stamp contacts a key blank retained on said bed, said swivel block being pivotable between an inoperative position visually exposing said bed for placement of a key blank thereon and an operative position wherein said indexing block and hole are positioned vertically above a retained key blank; and a plurality of spaced detents on said indexing block cooperable with spring-urged means on said swivel block for selectively positioning and spacing said hole over a key blank retained on said bed.

14. A locksmith tool according to claim 13 wherein the front face of said swivel block comprises a horizontal guide, said indexing block comprising a horizontal slide of complementary configuration and slidably receivable in said guide.

15. A locksmith tool according to claim 14 wherein said detents are formed in the rear surface of said slide, said spring-urged means comprising a spring-urge ball bearing mounted in said swivel block opposite said detents.

16. A locksmith tool according to claim 13 comprising a grid of guide lines on said key bed for facilitating accurate placement of a key on said bed for application of the stamp indicia thereon.

17. A locksmith tool according to claim 13 comprising a first stop plate secured to an edge of said swivel block and engaging said base block for retaining the indexing block in the operative position, and a second stop plate secured to an opposite edge of said swivel block engageable with said shoulder to prevent pivoting of the swivel block beyond said inoperative position.

18. A locksmith tool according to claim 13 comprising an alignment detent in the bottom wall of said swivel block and a spring-urged ball bearing in the bottom of said swivel block cooperable with the alignment detent for retaining the indexing block in the operative position.

* * * * *